US005077984A

United States Patent [19]

Vance

[11] Patent Number: 5,077,984

[45] Date of Patent: Jan. 7, 1992

[54] REFRIGERANT HANDLING UNIT

[76] Inventor: James H. Vance, 145 Longview Dr., Abingdon, Va. 24210

[21] Appl. No.: 494,306

[22] Filed: Mar. 16, 1990

[51] Int. Cl.[5] ..... F25B 45/00

[52] U.S. Cl. ..... 62/292; 62/149; 62/77

[58] Field of Search ..... 62/149, 292, 77, 195, 62/85

[56] References Cited

U.S. PATENT DOCUMENTS

| | | | |
|---|---|---|---|
| 2,977,773 | 4/1961 | De Kanter | 62/149 |
| 4,624,112 | 11/1986 | Proctor | 62/149 |
| 4,688,388 | 8/1987 | Lower et al. | 62/292 |
| 4,768,347 | 9/1988 | Manz et al. | 62/292 |
| 4,903,499 | 2/1990 | Merritt | 62/77 |

*Primary Examiner*—Albert J. Makay
*Assistant Examiner*—John Sollecito

[57] ABSTRACT

A readily portable refrigerant handling unit for withdrawing, receiving, storing and optionally recharging the refrigerant of a down refrigeration system under repair or servicing or the like, the unit accommodating interchangeable refrigerant reclaim tanks provided with refrigerant porting systems connectable to various down systems for allowing the flow of refrigerant therebetween, the unit being constructed of a housing providing a cavity for removably receiving a reclaim tank, an openable closure on the housing and/or the tank for substantially thermally sealing the tank in the housing, access conduits or equivalent structure in the housing for allowing connection of the tank to the down system, and a cooling system and optionally a heating system in the housing adapted to selectively cool or heat the tank to withdraw or recharge the refrigerant respectively from or to the down system.

18 Claims, 3 Drawing Sheets

REFRIGERANT HANDLING UNIT

This invention concerns the handling, i.e., the temporary withdrawing, storing and/or treating of refrigerant from refrigeration units under repair, removal or servicing, hereinafter referred to as "down system", and the recharging thereof if desired, to the repaired or serviced unit, and particularly concerns a readily transportable and convenient unit for performing the withdrawing, storing and recharging operations in a highly efficient and versatile manner.

In the refrigeration or air-conditioning field, when a system breaks down or becomes otherwise inoperative for servicing or the like, all the refrigerant gas or liquid, is expelled to the atomosphere or withdrawn by an auxilliary apparatus to a reclaim vessel. Such is necessary since the refrigeration unit is usually unable to pump its own refigerant into any kind of storage tank under its own power. The use of an auxilliary storage or reclaim vessel is a viable alternative to discharging the refrigerant to the atmosphere, however, such a vessel must either be dedicated to use for the particular refrigerant of the system, or must be thoroughly cleaned out before using it for another system employing different refrigerant. Since reclaim units are expensive, a common experience is to use the same reclaim vessel in a contaminated condition for a variety of refrigerants.

Heretofore, various apparatus have been developed for coupling to the down system for withdrawing the refrigerant therefrom and temporarily storing it, and then, after the repair or servicing has been completed, recharging the refrigerant back to the system. During the withdrawing and storing operations, it has also been customary to treat the refrigerant in various ways to reduce the levels of oil and other impurities entrained therewith. Such apparatus or servicing units are described, for example, in U.S. Pat. Nos. 4,285,206; 4,363,222; 4,261,178; and 3,232,070. The construction of these servicing units all include a storage tank permanently installed in the circuit of an auxilliary cooling system such as a conventional refrigeration system, which is connectable into the high pressure and low pressure sides of the down system to pull the refrigerant therefrom. In a variation of such servicing units, U.S. Pat. No. 4,539,817 discloses a storage or reclaim tank of a servicing unit fluid connectable to a system under repair but having its cooling system isolated, i.e., not fluid connected to the down system.

In all of these patents, the disclosures of general refrigeration construction and operation of which are incorporated herein by reference, no provision is made for easy, rapid, and convenient adaptation of the servicing unit to refrigeration systems employing different refrigerants such as trichlorofluoromethane, dichlorodiflurormethane, dichlorofluoromethane, and chlorodifluoromethane. In this regard, it is particularly noted that a refrigeration system designed for one type of refrigerant cannot tolerate any significant amount of another refrigerant without losing efficiency and encountering other problems well recognized in the field.

Objects therefore, of the present invention are: to provide a refrigerant handling or servicing unit, especially an easily portable one, for withdrawing, storing, and recharging the refrigerant of a down system, wherein the unit is constructed to allow convenient and rapid adaptation thereof to different refrigeration systems employing different types of refrigerant material; and to provide such unit of simple and economical construction and operation.

These and other objects hereinafter appearing have been attained in accordance with the present invention which is defined in its broad sense as a refrigerant handling unit for withdrawing, storing and recharging the refrigerant of a down system, comprising refrigerant reclaim tank means having refrigerant porting means connectable to said down system for allowing the flow of refrigerant between it and said tank means, housing means, cavity means in said housing means having entry means opening through said housing means for allowing easy insertion into and removal from said cavity means of said tank means, openable closure means cooperable with said housing means for substantially thermally sealing said entry means, access means in said housing means for allowing fluid connection of said porting means to said down system, and cooling means in said housing means adapted to cool said tank means to withdraw said refrigerant from said down system.

It is noted that in the present unit as above defined, the tank means is an interchangeable item and several tanks of equivalent structure for accommodating different types of refrigerant are included within the term "tank means". Only one tank is typically used for a particular system at a time, however, two or more maybe employed, e.g., where a large down system is involved.

In certain preferred embodiments of the invention:

the cooling means, and heating means if employed, are permanently affixed in the housing means at locations which allow the tank means to be readily removed from and installed in the cavity means;

the cooling means comprises a refrigeration system independent of the down system and having compressor means, condenser means, evaporator means, and chiller conduit means connected in series in a closed loop, the chiller conduit means adapted to lie in close proximity to portions of the tank means for chilling the same; and the access means comprises slot means in a portion of the housing wall means adjacent the entry means and opening toward the closure means to receive the porting means upon full insertion of the tank means into the cavity means.

Other objects and preferred embodiments will become evident from the following description and drawings wherein.

Figure 1:
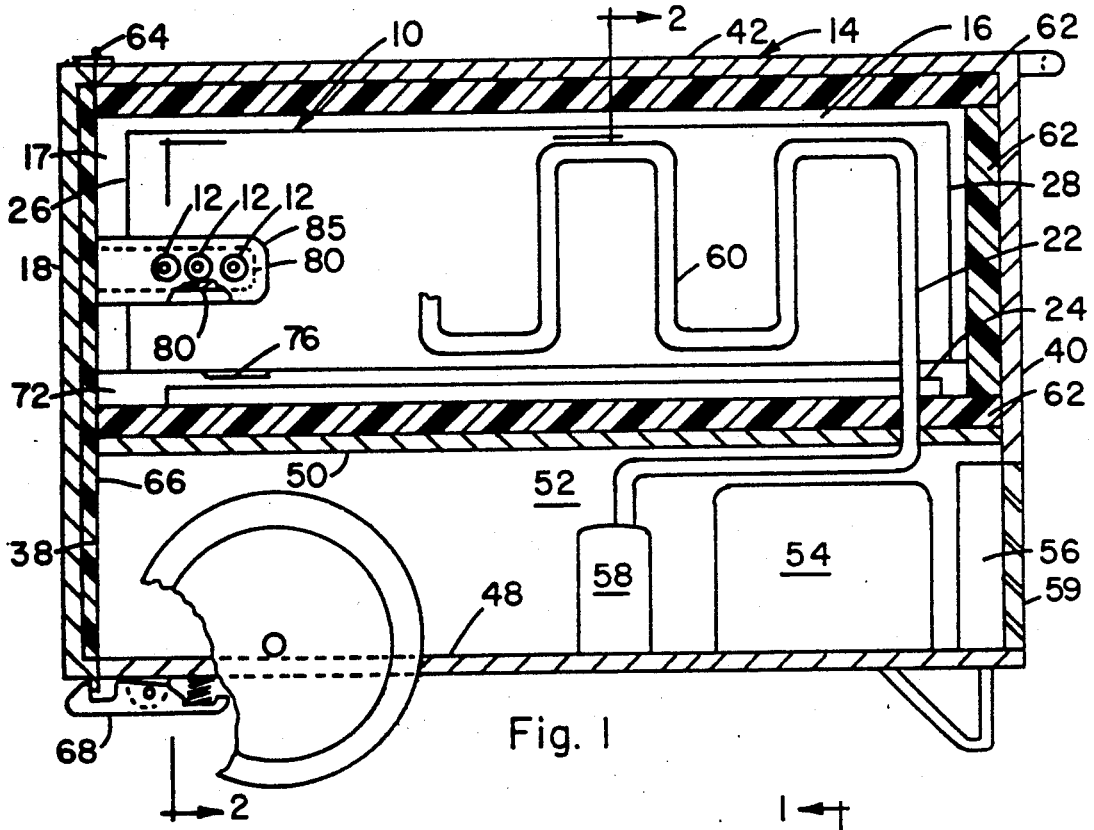
FIG. 1 is a longitudinal cross-sectional view of the present refrigerant handling unit with one side of the housing removed and with certain dimensions shown enlarged for purposes of clarity.

Referring to the drawings, and with particular reference to the claims hereof, the refrigerant handling unit comprises refrigerant reclaim tank means 10 having refrigerant porting means 12 connectable to either or both the high pressure or low pressure sides of a down system for allowing the flow of refrigerant between it an said tank means, housing means 14, cavity means 16 in the housing means having entry means 17 opening through the housing means for allowing easy insertion into and removal from the cavity means of the tank means, openable closure means 18 cooperable with the housing means for substantially thermally sealing the entry means, access means 20 in the housing means for allowing fluid connection of the porting means to the down system, and cooling means 22, and heating means 24 if employed, in the housing means adapted to selectively cool or heat the tank means to withdraw or recharge respectively the refigerant from or to the down system.

Figure 6:
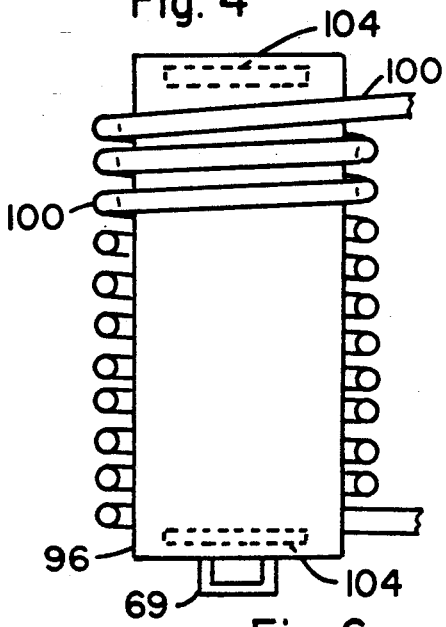
FIG. 6 is a top elevation of one of the tank means of FIG. 5.
Figure 5:
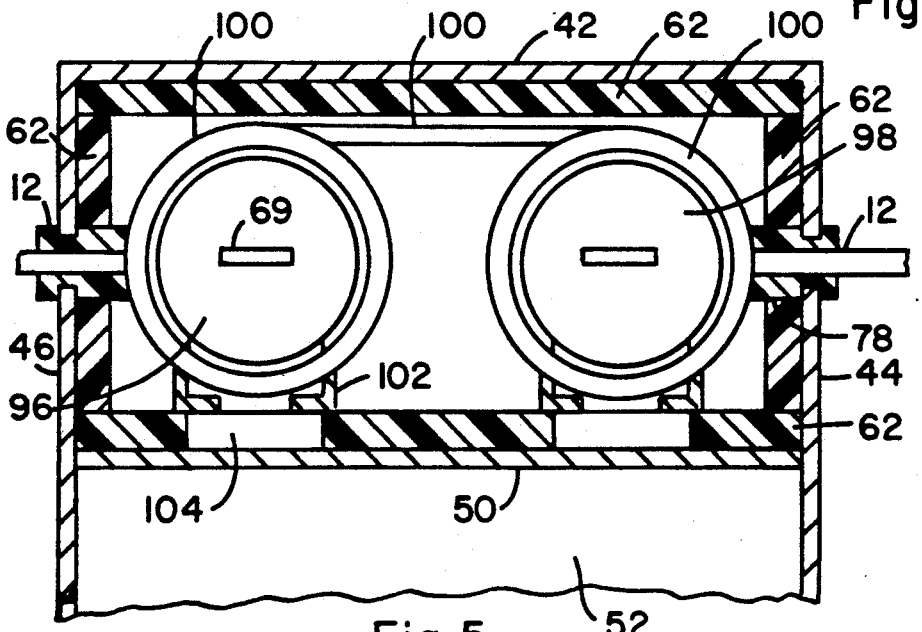
FIG. 5 is a front view of a variation of the tank means and cooling means.

The tank means 10 is shown as a rectangular box having a front 26, back 28, top 30, sides 32 and 34, and bottom 36. It is particularly noted that the shape of the tank can be varied greatly and may, for example, have a cylindrical configuration as shown in FIGS. 5 and 6.

The housing means 14 also is shown with a rectangular configuration comprising a front 38, back 40, top 42, sides 44 and 46, and floor 48. A partition plate 50 affixed by welding or the like to the sides and back of the housing substantially divides the housing into the cavity means 16 for housing the tank 10 and into utility chamber 52 for housing the body of the chiller or cooling means such as a refrigeration compressor and motor unit 54, condenser 56, evaporator 58, cooling vent 59 and conventional refrigerant circuit conduits, not shown. Such a cooling means which can be employed in the present invention is shown and described in U.S. Pat. No. 3,232,070, the disclosure of which is incorporated herein by reference.

Figure 2:
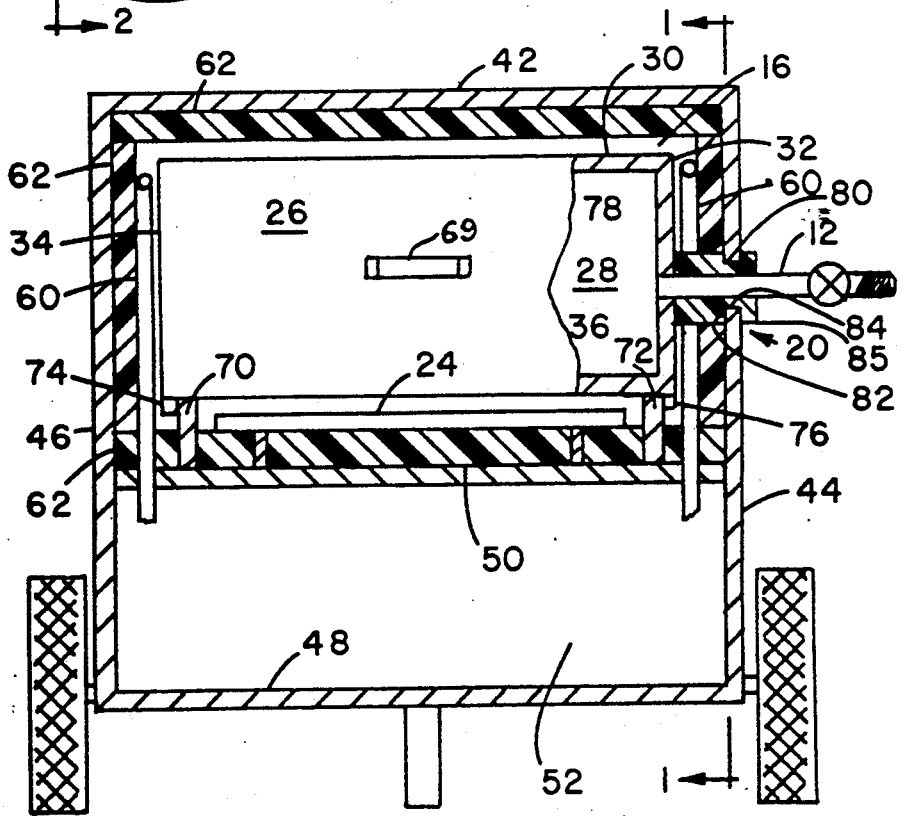
FIG. 2 is a lateral, cross-sectional view, with portions shown in elevation, taken along line 2—2 of FIG. 1 in the direction of the arrows.
Figure 3:
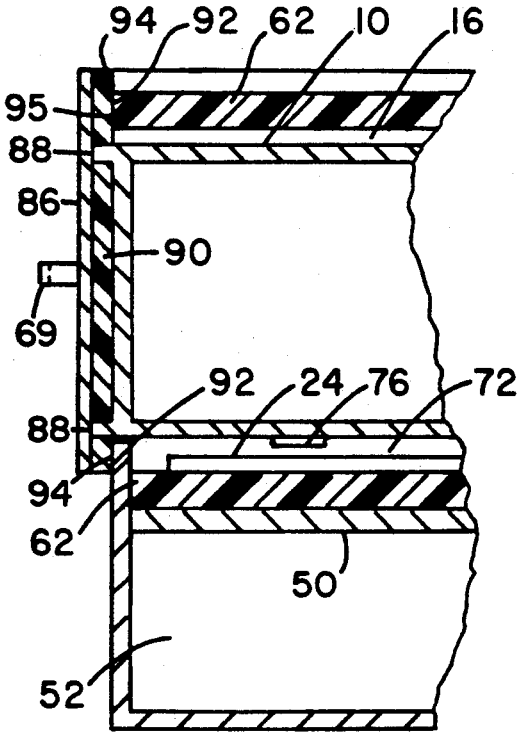
FIG. 3 is a longitudinal, cross-sectional view of a variation of the cavity closure means and adjacent housing structure of FIG. 1.

In the present unit, the evaporator coils themselves or branches therefrom designated 60 are positioned in the housing such that they can rapidly cool the reclaim tank 10. In the embodiment of FIGS. 1-3, the branches are run up through partition plate 50 and fixed in the housing in close proximity to the sides and, if needed, the back of the tank. The number of cooling or chiller coils or branches employed and their specific locations in the housing can be varied. Insulation such as foamed polystyrene or polyurethane sheets 62 are provided to line the interior of cavity 16 for maintaining good cooling or heating efficiency.

The front of the housing is provided with closure means 18 in the form of a door hinged in any convenient manner such as by hinges 64 to be openable to provide entry through the front 17 of the housing into cavity 16. The door is preferably provided with an insulating sheet 66 which substantially thermally seals against the cavity insulation lining 62 when closed. One or more spring urged latches such as 68 or any equivalent structure is provided to retain the door in a tightly closed position during operation of the present unit. Handle means such as 69 may be provided on the tank to assist in the manipulation thereof.

A pair of longitudinally extending rails such as 70, 72 or equivalent structure, affixed to plate 50 provide a base upon which tank 10 can readily slide into or out of cavity 16. Longitudinally extending guide bars 74, 76 affixed to the underside of the tank bottom prevent excessive lateral movement of the tank which otherwise might damage the chiller branches.

Figure 4:
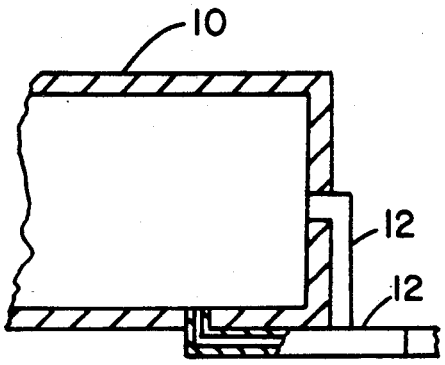
FIG. 4 is a variation of the location of the porting means on the reclaim tank means.

The porting means 12 comprising conduit or pipe segments are hermetically sealed and affixed to one or more walls of the tank such as wall 32 in any desired number and location and principally provide fluid communication between the tank and the down system but other such segments can provide connection to auxilliary equipment such as oil drain means, scavenger pump means for insuring total evacuation of the down system, refrigerant purging system, refrigerant purification means, or the like as is known in the art. These porting conduit segment may be positioned on the tank in any location, e.g., an oil drain line may be provided at the bottom of the tank, in which case all of the porting lines 12 could be positioned at the lower part of the tank wall, or alternatively run down the side of the tank as shown in FIG. 4 such that a single porting grommet as shown and described below could be employed. Also, however, multiple porting grommets or equivalent means can be employed.

The conduits 12 are preferably mounted in a grommet 78 which is securely affixed to wall 32 of the tank by adhesive or mechanical means or both. The grommet is provided with a peripheral recess 80 which is dimensioned to readily slidably receive the side wall edge portions 82 defining slot 84 formed in housing side wall 44 as shown in FIGS. 2 and 5 as the tank with the conduits 12 affixed thereto is slid into cavity 16. The grommet preferably extends to the insulation sealing surface 66 of the door 18 to complete the substantial thermal sealing of the tank cavity. The outer portion 85 of the grommet may be omitted since the rails 72, 70 can maintain the neck of the grommet laterally within wall slot 84.

Referring to FIG. 3 wherein structure equivalent to that of FIGS. 1 and 2 are numbered the same, a variation in the closure means 18 is shown as comprising a plate 86 welded or the like to the wall ends 88 of the tank 10. This plate preferably carries a thermal insulation pad 90 on its inner surface with the outer peripheral portion 92 of the pad thermally sealing against end portions 94 of the housing and end portion 95 of the insulation surrounding and defining the entry into cavity 16 when the tank is inserted all the way therein. Any suitable latching means such as shown in FIG. 1 may be provided to maintain a tight thermal seal of closure plate 86 against the housing when the unit is in operation.

Referring to FIGS. 5 and 6, a variation of the present unit is shown wherein the reclaim tank is circular in cross-section and multiple tanks 96 and 98 are enployed. In this embodiment, the two tanks may be used simultaneously on the same or different down systems and the tank ported thereto from opposite sides of the housing. A single section of chiller conduit 100 encircling both tanks as shown may be employed and the tanks ported at the front or close thereto to allow maxumum chilling area. The recharging heater element in this embodiment maybe positioned adjacent the rear of the tanks. In these figures, the coils are carried by and preferably affixed to longitudinally extending angle iron or the like supports 102 affixed to pillars 104 affixed to plate 50 adjacent the front and rear of the housing. The coil ends are typically connected into the cooling or evaporator side of a refrigeration unit for receiving the cold, low pressure refrigerant gas therefrom.

Figure 7:
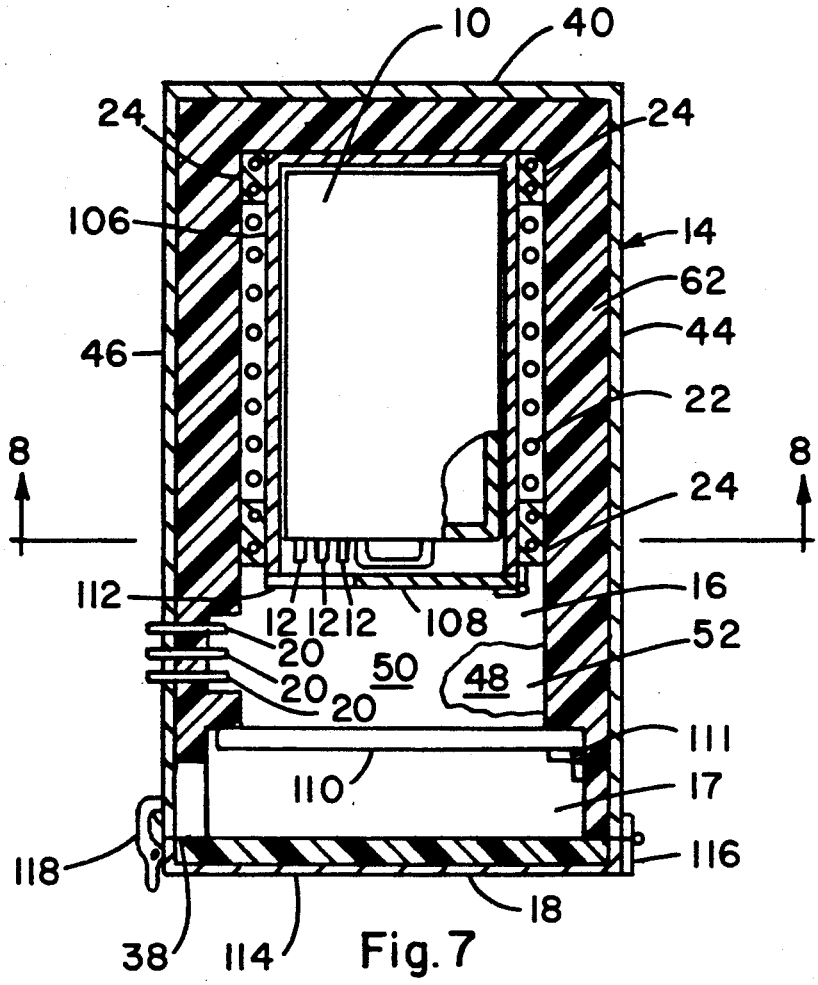
FIG. 7 is a longitudinal cross-sectional view of a variation of the unit showing internal porting means.
Figure 8:
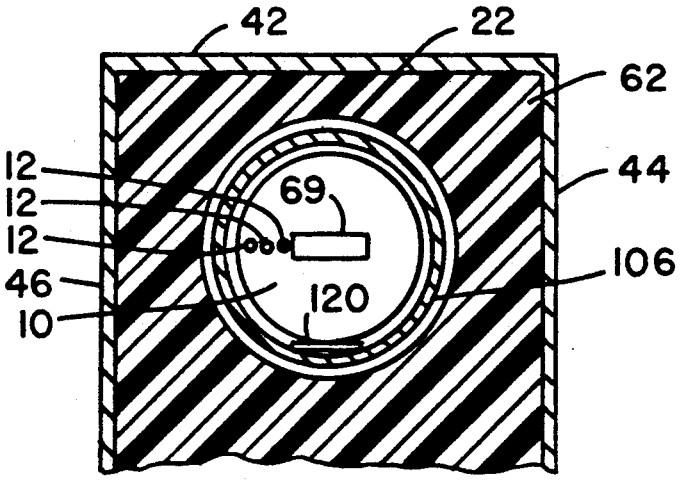
FIG. 8 is a view taken along line 8—8 of FIG. 7 in the direction of the arrows.

Referring to FIGS. 7 and 8, a variation of the housing and porting systems are shown. In this embodiment, the tank porting 12 is internal of cavity 16 and connections are made by any conventional types of air conditioning hoses and threaded fittings to the access conduit segments 20 which extend through the side 46 or any other portion of the housing 14 for threaded connection to hoses going to the down system. Where it is desired to provide the tank with an oil drain, the drain port from the tank can be connected to a sump located, for example, in the utility chamber 52. As shown, a sheet metal cylinder 106 is surrounded by the refrigerant cooling coils 22, and a pair of electrical resistance heaters 24 encircle the end portions thereof to provide recharge heating. A door 108 hinged at 109 and/or door 110 hinged at 111 may be provided internally to assist in thermally insulating the unit Door 108 is provided with a slot 112 for allowing its closure with ports 12 conveniently extending therethrough for easy access for connection by hoses to conduits 20. The main thermal sealing, of course, is provided by the insulated door 114 hinged at 116 and snap fastened at 118. In this embodiment the cylinder 106 is preferably dimensioned to receive a cylinder reclaim tank in a close fitting sliding manner to enhance the efficiency of the cooling and heating of the tank.

In FIG. 8 is shown a flexible pressure plate 120 on which tank 10 rests. This plate, or any equivalent spring structure, comprises an element of an electrical pressure switch which cuts off the refrigerant inlet port, i.e., solenoid valve, to the tank when the refrigerant weight in the tank exceeds a pre-set valve. Such devices are highly desirable as shown by switch 52 in U.S. Pat. No. 4,363,222, the disclosure of which is incorporated herein by reference.

In utilizing the present refrigerant handling unit, the unit is easily transported to the site of the down system which conventionally is provided with servicing connection valves for both the high and low sides of the refrigeration system. The connection of either or both of these valves is readily made to the porting means 12 of the present unit by suitable conduit means in known manner. Suitable valving, pressure guages filters and dryers are employed in the reclaim system, connecting lines, or the like to monitor and regulate the pressure of the down system and the present tank means and to purge and clean the refrigerant and reclaim apparatus. Typical multi-purpose line filter driers are exemplified by Type DK Plus of ALCO Controls of St. Louis, Mo.

In operation, the tank means 10 is cooled to its refrigerant withdrawal temperature of about 0 F. by the refrigeration unit 54 which can be of any type, including conventional gas-liquid filled evaporator or flooded evaporator. The valving is then or previously opened to connect the reclaim tank to the down system and allow the refrigerant to migrate to the tank. Typically, the migration is completed in about 20 minutes and at this time a scavenger pump may be actuated in the reclaim system connected into the porting means to pull the pressure down to about zero lbs. gauge in the down system, whereupon the valving to the down system is closed off. It is noted that scavenging is unnecessary if the reclaim tank is brought to a low temperature, e.g., −20 F. At this time, and while the down system is being repaired, the refrigerant may be recirculated by the scavenger pump or other such means in the reclaim system through various oil and impurity separation means to bring the refrigerant to its proper oil content, moisture content, or the like condition. Also, make-up refrigerant may be added during this operation. When the repairs to the down system are completed, the tank is heated to bring the reconditioned refrigerant therein to a pressure of about 125 lbs. gauge. With the high and low pressure sides of the down system under vacuum, the valving is actuated to open the line to the tank to allow the reconditioned refrigerant to flow back into the down system.

This invention has been described in detail with particular reference to preferred embodiments thereof, but it will be understood that variations and modifications will be effected within the spirit and scope of the invention.

I claim:

1. A refrigerant handling unit for withdrawing the refrigerant of a down system, comprising refrigerant reclaim tank means having refrigerant porting means connectable to said down system for allowing the flow of refrigerant between it and said tank means, housing means, cavity means in said housing means having entry means opening through said housing means for allowing easy insertion into and removal from said cavity means of said tank means, openable closure means cooperable with said housing means for substantially thermally sealing said entry means, access means in said housing means for allowing fluid connection of said porting means to said down system, and cooling means in said housing means separate from but adjacent said tank means for cooling the same to withdraw said refrigerant from said down system to said tank means.

2. The unit of claim 1 wherein said cooling means is permanently affixed in said housing means at locations which allow said tank means to be readily removed from or installed in said cavity means.

3. The unit of claim 1 wherein said cooling means comprises a refrigeration system independent of said down system and having compressor means, condenser means, evaporator means, and chiller conduit means connected in series in a closed loop, said chiller conduit means adapted to lie in close proximity to portions of said tank means for chilling the same.

4. The unit of claim 3 wherein said refrigeration system is a combination refrigeration and heat pump to provide the cooling and heating of said tank means for withdrawing and recharging respectively the refrigerant of the down system.

5. The unit of claim 3 wherein tank heating means is provided for recharging said down system and comprises an electrical resistance heater located in close proximity to portions of said tank means.

6. The unit of claim 1 wherein said tank means is provided with auxilliary porting means for selectively connecting said tank means to auxilliary equipment.

7. The unit of claim 1 wherein said housing means comprises a generally box-like configuration having wall means providing floor means, top means, opposing side means, and opposing end means, cavity entry means in said wall means for allowing the insertion into or withdrawal from said cavity means of said tank means, and support means in said cavity means for slidably receiving said tank means through said entry means.

8. The unit of claim 3 wherein said chiller conduit means extends adjacent to a substantial portion of the exterior surface of said tank means.

9. The unit of claim 8 wherein said chiller conduit means comprises portions of the evaporator coil of a refrigeration system.

10. The unit of claim 9 wherein heater means is provided and said portion of said evaporator coil and said heater means lie adjacent to different portions of the exterior surface of said tank means.

11. The unit of claim 7 wherein said tank means also has a generally box like configuration and a forward end wall thereof is providing with handle means for assisting in inserting and withdrawing of said tank means into and from said cavity means respectively.

12. The unit of claim 1 wherein said closure means comprises door means hinged to said housing means and pivotal outwardly therefrom to allow said tank means to be moved through said entry means into and out of said cavity means.

13. The unit of claim 1 wherein said closure means comprises rim means on said tank means adapted to substantially thermally sealingly abut adjacent portions of said housing means which form said entry means upon full insertion of said tank means into said cavity means.

14. The unit of claim 1 wherein said access means comprises slot means in a portion of said wall means adjacent said entry means and opening toward said closure means to receive said porting means upon full insertion of said tank means into said cavity means.

15. The unit of claim 14 wherein said porting means comprises fluid conduit means affixed at one end to said tank means and extending at its other end outwardly through grommet means, said grommet means and said slot means being dimensioned to provide a sliding fit therebetween as said tank means is inserted into said cavity means.

16. The unit of claim 14 wherein said porting means comprises fluid conduit means affixed at one end to said tank means and adapted to extend at its other end outwardly through said slot means, and fluid flow control valve means positioned in said conduit and adapted to be positioned means externally of said housing means when said tank means is fully inserted into said cavity means.

17. The unit of claim 1 wherein said cooling means comprises portions of the evaporator coil of a refrigeration system and encircle a sheet metal cylinder into which said tank means is readily slidable.

18. The unit of claim 17 wherein said access means comprises conduit segments perm anently installed through a wall portion of said housing means and adapted to be fluid connected to said porting means internally of said housing means.

* * * * *